United States Patent [19]

Itoku

[11] 4,218,791

[45] Aug. 26, 1980

[54] DEVICE FOR USE AS A BED OR BEDSTEAD

[76] Inventor: Ko Itoku, 4713, Uenohara,Uenohara-machi, Kitatsurugun, Yamanashi Pref., Japan

[21] Appl. No.: 944,800

[22] Filed: Sep. 22, 1978

[30] Foreign Application Priority Data

Dec. 28, 1977 [JP] Japan ..... 52-175714[U]

[51] Int. Cl.[2] ..... A61B 19/00; F24F 9/00

[52] U.S. Cl. ..... 5/284; 5/423

[58] Field of Search ..... 5/284, 421, 423; 297/283, 453; 128/331 R; 126/205; 109/1 S

[56] References Cited

U.S. PATENT DOCUMENTS

| | | | |
|---|---|---|---|
| 771,847 | 10/1904 | Titus | 5/284 |
| 1,762,663 | 6/1930 | McLeod | 5/284 |
| 1,891,903 | 12/1932 | Bang | 5/284 |
| 2,474,101 | 6/1949 | Frothingham et al. | 311/211 |
| 4,129,123 | 12/1978 | Smidak | 109/1 S |

*Primary Examiner*—Casmir A. Nunberg
*Attorney, Agent, or Firm*—Thomas R. Morrison

[57] ABSTRACT

A device for use as a bed or bedstead or a mattress in its entirety or as a combination of a bedstead and a mattress. A sleeping mat or a bed quilt is placed on the device arranged as a bedstead and may or may not be placed on the device arranged as a mattress alone or as a combination of the bedstead and mattress. A horizontal passage is provided within the device for communicating with an area of the sleeping mat or the upper mattress surface and with a vertical passage provided to one end of the device and having an air discharge opening for providing an air circulation through the bed inside with a zone of the sleeping mat or the upper mattress surface and the interior space of the bedroom.

25 Claims, 10 Drawing Figures

DEVICE FOR USE AS A BED OR BEDSTEAD

The present invention relates to a device for use as a bedstead or a mattress or a combination of a bedstead and a mattress. A bedquilt may be placed on the bedstead if used by itself and may or may not be placed on the mattress used by itself or a combination of the mattress and the bedstead.

Among the functions required of a bed device for use as a bed in general are good adaptability to a human body capability to maintain a sanitary sleeping environment, and good durability. In order to meet these requirements, a bed device should fit the human body and be capable of promoting sleep and rest. Moreover, the bed device should have a soft hand feeling and proper cushioning. In addition, the bed device should optimally preserve heat and be kept cool in hot weather. The property of optimal heat preservation is especially required because less body warmth is generated during sleep and more heat may be dissipated from the human body.

The characteristic of heat preservation of a bed device depends mainly on the material of the device. In general, too any coverlets may disturb good sleep even though the dissipation of body warmth may be thereby prevented.

During sleeping the body temperature may be adjusted autonomously by perspiration. Most of perspiration may be absorbed into the sleeping mat or bed quilt which is usually kept in a moist condition. The bed quilt made of a material capable of absorbing much perspiration may be said to contain much moisture. A bed quilt which has thus come to contain much moisture may be likely to interfere with good sleep and smooth adjustment of body temperature. The quilt should therefore be kept in a dry condition.

The quilt can be dried in the sun, but drying in the sun cannot be performed in the districts where there is much snowfall or relative humidity is that high.

It is therefore an object of the present invention to provide a bed device having a good property to keep body warmth and which can be kept cool during hot weather.

It is another object of the present invention to provide a bed device wherein the bed quilt placed thereon may be dried in situ.

It is a further object of the present invention to provide a bed device wherein the room air may be cleaned by disinfection and/or deodoration.

According to the present invention there is provided a device for use as a bed or bedstead comprising a supporting base portion constructed or formed so as to permit air to pass therethrough, a generally horizontal passage provided within or as part of said base portion and extending beneath the upper surface of the base portion, and communicating with a space above the base portion; one end portion of said horizontal passage being in communication with the lower end of an upwardly extending passage provided at said one end of the generally horizontal passage, and a closable air discharge portion being provided at the upper end of the upwardly extending passage for communicating with the air space surrounding the device. A germicidal lamp and/or a deodorizer may be provided within said horizontal passage and/or the upwardly extending passage.

The invention will be described further by way of example, with reference to the accompanying drawings, in which.

FIGS. 7 to 10 each show further modified embodiments.

Figure 1:
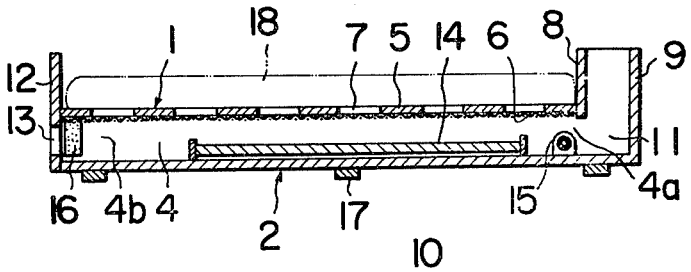
FIG. 1 is a longitudinal section through a bed device.
Figure 2:
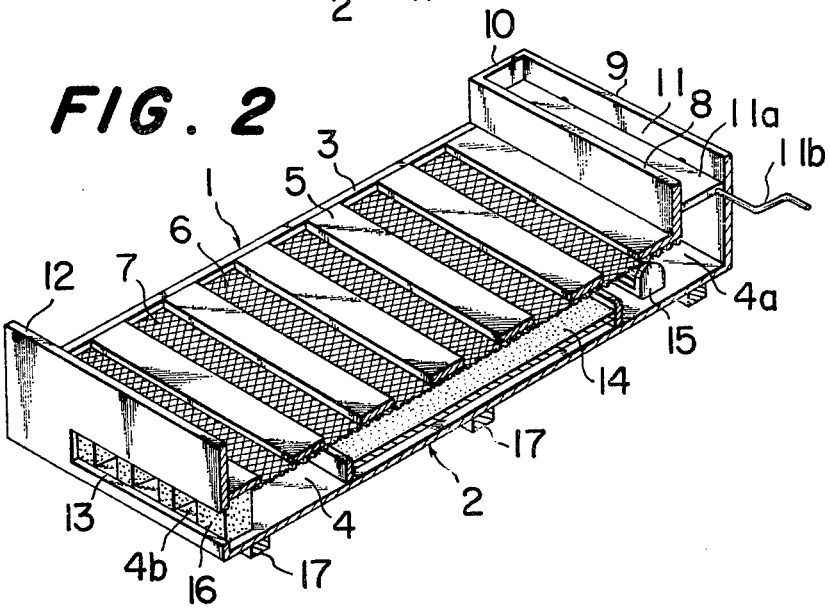
FIG. 2 is a perspective view of the device of FIG. 1 with parts being cut away.

In FIGS. 1 and 2, a bed device is shown arranged as a bedstead having a base portion of a double floor structure comprising an upper floor 1 and a lower floor 2. The upper floor 1 and the lower floor 2 extend parallel to and are spaced a desired distance from one another. A rectangular horizontal passage 4 is defined by said upper and lower floors and side frames 3 mounted on both sides of the bed device. The upper floor 1 comprises a plurality of transverse bars 5 spaced apart at a desired distance from one another and an air permeable woven cloth 6 which is placed on the lower surfaces of the transverse bars 5. The zones 7 intermediate these transverse bars and the zone above said upper floor communicate with said horizontal passage 4 through the air-permeable woven cloth 6.

A double wall structure comprising an upright inner wall 8 and an upright outer wall 9 is provided to one longitudinal end of said base portion, said inner and outer walls 8 and 9 defining a vertically extending passage 11 together with side walls 10 on either side of the bed device. The passage 11 communicates with one **4*a* of a pair of end portions 4*a*, 4*b*, formed on both longitudinal ends of said horizontal passage 4. An upright end frame 12 is formed on the other end portion 4*b* of the base portion, said end frame 12 fronting said end portion 4*b* and having air circulation opening means 13 for communication between the passage 4** and the ambient space of the bedroom in which the device is located.

A panel heater 14 or the like radiator means and a germicidal lamp 15 are provided at desired positions within the horizontal passage 4. A deodorizer 16 may also be mounted at the end portion **4*b* communicating with the horizontal passage. In the drawings, the numeral 17 denotes crosspiece support means, and the numeral 18** denotes a bed quilt.

In use of the device described above heat of the heat radiator 14 may be dissipated into the flat horizontal passage 4. The upper floor 1 which forms the ceiling of the horizontal passage 4 is heated mainly by the heat radiation and convection. Part of the heated air may be directed through the cloth 6 and the zones 7 intermediate the bars 5 to the bed quilt placed on the upper floor 1, so that the mattress may be warmed and dried by said warm air and the heat radiation.

On the other hand, part of the warmed air in the horizontal passage 4 is directed to the vertical passage 11 by the chimney effect provided by the passage end **4*a* communicating with the passage 4, and discharged into the room. Simultaneously, the cold room air is drawn into the horizontal passage 4 through the end portion 4*b* communicating therewith. The room air may thus be positively circulated through said horizontal passage 4** for room heating and air circulation through the room. The temperature of the room air and that of the base portion may be adjusted automatically if thermostat means is used in a known manner for controlling the radiator operation.

In this embodiment, the end portion 4*b* is provided at the longitudinal end of the bed device. It may, however, be positioned on the transverse end face or bottom of the bed device without departing from the scope of the present invention.

In cases where the deodorizer 16 and the germicidal lamp 15 are provided in the horizontal passage 4, as is shown in the drawings, the air introduced through the inlet opening 4*b* is deodorized and filtered by the deodorizer 16 and sterilized by the lamp 15. Thus the room air may be cleaned simultaneously with heating and circulation. A similar cleaning effect may be achieved by providing the lamp 15 and the deodorizer 16 in the vertical passage 11. The germicidal lamp has an effect of heat radiation and therefore simultaneously acts for heat generation.

An air flow control plate 11*a* is provided in the vertical passage 11 for rotary displacement manually by a handle 11*b* from outside of the bed device. In this case, the air flow through the vertical passage 11 may be controlled for adjusting the temperature of the base portion, and the heat generator may be reduced in size. The control plate may be designed as a blind or a cover plate.

In cases where the heat radiator 14 of the bed device is not used, as during summer, part of the heat dissipated from the user's body is discharged through the zones 7 of the upper floor 1 into the horizontal passage 4 and discharged into the room through the vertical passage 11 by the chimney effect. As the heated air is discharged into the room through the passages 4,11, fresh air is introduced into the horizontal passage through the inlet opening 4*b*. Thus the compulsory air circulation through the room may be attained, as when the heat radiator 14 is used for providing a positive heat dissipation from the base portion of the bed device. The moisture contained in the bedquilt may be discharged into the horizontal passage 4 for improving spontaneous drying of the bed quilt. If the heat radiator is used, the bed quilt may be dried compulsorily.

Figure 3:
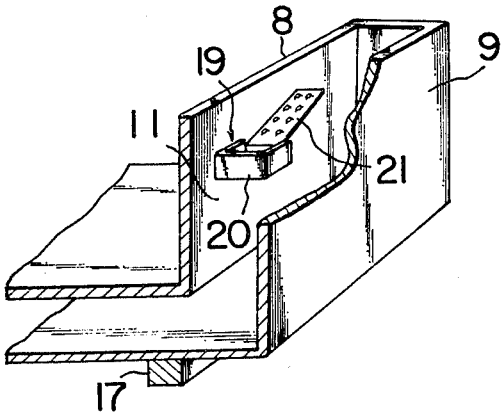
FIG. 3 is a fragmentary view of a portion of the bed device of FIG. 1 illustrating the mounting of a humidifier.
Figure 4:
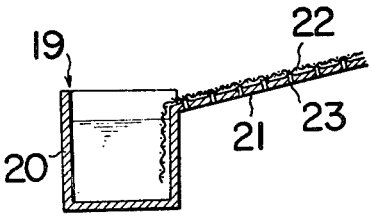
FIG. 4 is a longitudinal section through the humidifier of FIG. 3.

In FIGS. 3 and 4, there is shown a modified embodiment of the invention wherein a humidifier 19 is provided in the vertical passage 11. The humidifier 19 comprises a water box 20, a perforated plate extending outwardly in the upper oblique direction from the one edge of the water box 20 and a piece of woven cloth 22 extending from the inside of the box 20 along the upper surface of the perforated plate. The water sucked up from the inside of the box by the capillary action provided by the cloth 22 is forcibly contacted with warm air passing through the perforations 23 of the plate 21 for controlling the humidity of the room air.

In the present embodiment, the humidifier 19 is carried by the inner side wall 8 constituting the vertical passage 11, but it may be mounted to any other position capable of providing forced contact between the sucked water and warm air. The humidifier 19 may be mounted fixedly or removably as the case may demand. The perforations 23 in the plate 21 may preferably extend vertically from the plate surface carrying the cloth 22 for returning the water deposited on the plate surface into the box 20 by virtue of the inclined plate surface.

Figure 5:
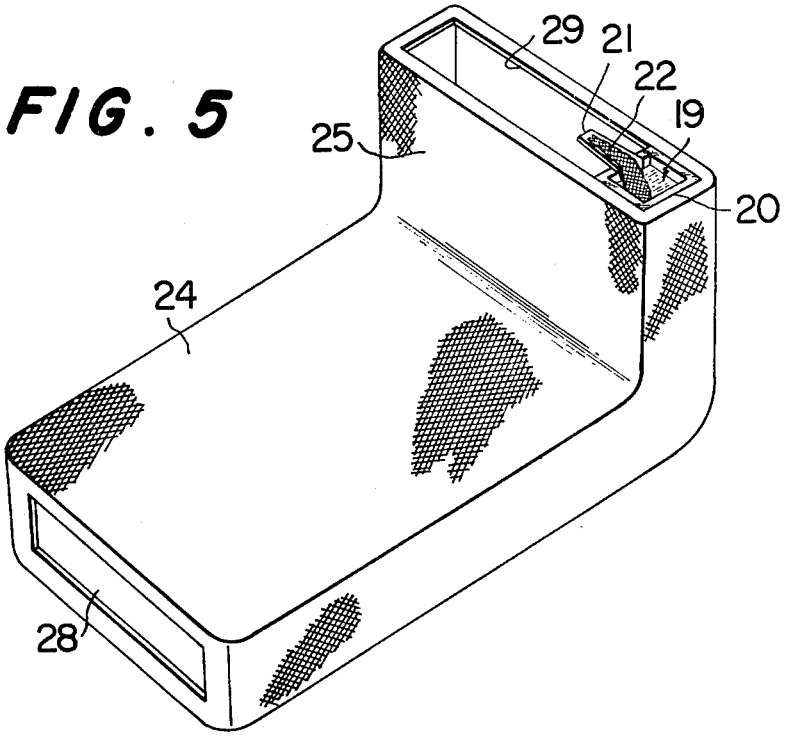
FIG. 5 is a perspective view of a modified embodiment where the device is in the form of a mattress.
Figure 6:
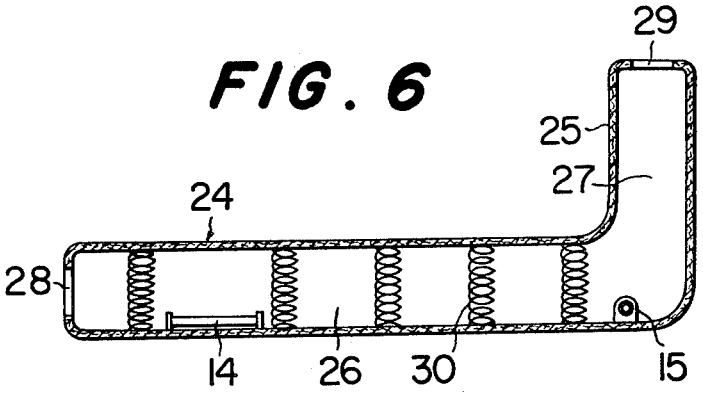
FIG. 6 is a longitudinal section of the device of FIG. 5.

In FIGS. 5 and 6, there is shown a bed device formed as a hollow mattress made of woven cloth or similar air permeable material. The mattress comprises a base portion 24 and an upright portion 25 at one end of the base portion 24. A hollow space in the base portion 24 serves as a horizontal passage 26, while a hollow space in the upright portion serves as a vertical passage 27. The end face of the base portion 24 and the upper end of the upright portion 25 are formed with air permeable openings 28, 29 respectively. In the hollow space of the base portion 24, there are provided a heat radiator 14, a germicidal lamp 15 and a plurality of coil springs 30 designed to keep up the shape of the mattress. A humidifier 19 is provided in an opening 29 of the upright portion 25.

A similar effect as described with reference to the preceding embodiments may be realized in the embodiment of FIGS. 5 and 6.

In FIGS. 7 to 10, there are shown modified embodiments of the invention each comprising a combination of a bedstead and a hollow mattress. In these Figures, the same or similar components as those shown in the preceding embodiments are indicated by the same reference numerals.

Figure 7:
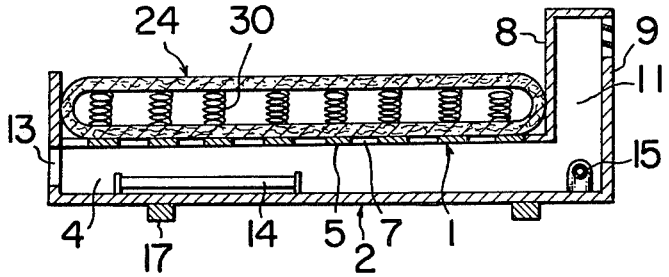

In the embodiment of FIG. 7, the mattress is formed by a base portion 24 made of air permeable material and placed on the upper floor 1 of the bedstead, and an air discharge opening of the vertical passage 11 is formed in the outer side wall 9.

Figure 8:
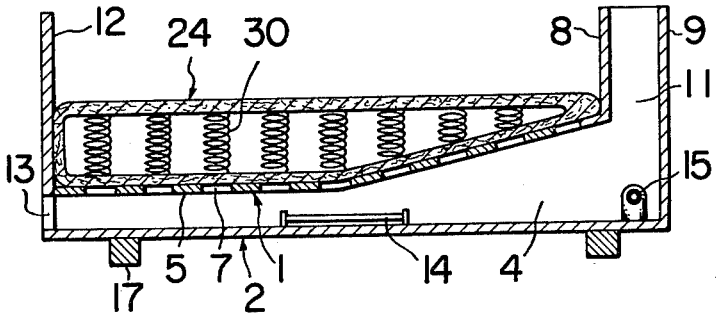

In the embodiment of FIG. 8, part of the upper floor 1 of the bedstead is inclined upwardly so that the horizontal passage 4 is tapered towards the vertical passage 11 in vertical elevation 1 for promoting the flow of warm air towards the vertical passage.

Figure 9:
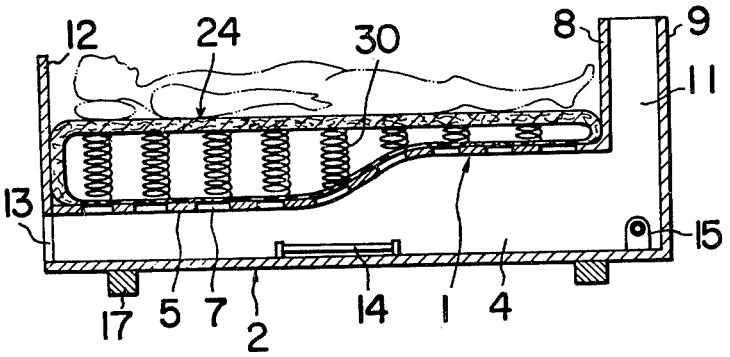

In the embodiment of FIG. 9, part of the upper floor 1 is raised stepwise for enlarging the section of the horizontal passage communicating to the vertical passage 11.

Figure 10:
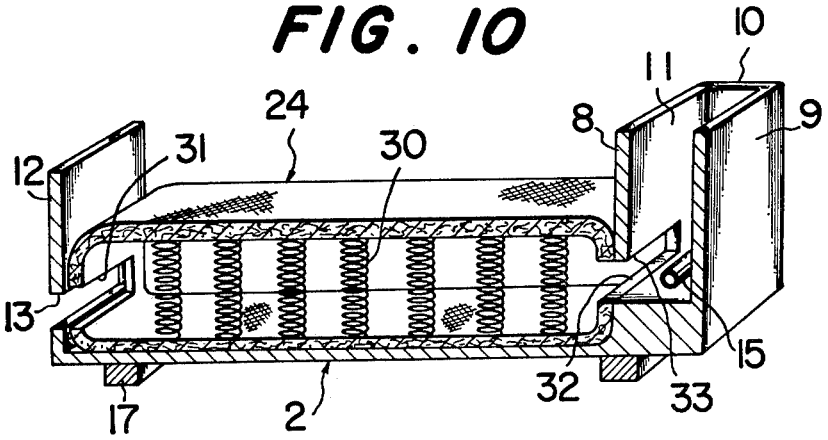

In the embodiment of FIG. 10, the mattress is formed by a base portion 24 and placed on the lower floor 2 of the bedstead. The longitudinal end faces of the base portion 24 are formed with air passage openings 31, 32. The opening 31 is provided in a position corresponding to the air passage opening 13 of the vertical wall 12 and the other opening 32 is provided in a position corresponding to an air passage opening 33 of the inner wall 8 constituting the vertical passage 11.

The base portion of the bed device described above and according to the invention is of an air permeable construction, and a horizontal passage is provided beneath said base portion for communication with the zone above the base portion for the overall area of the base portion. The horizontal passage communicates in one end opening thereof with the lower end of the vertical passage partitioned at the one end of the base portion for providing the desired properties of the bed device described in the foregoing.

Thus, with the use of the heat radiator provided in the horizontal passage, the bed quilt placed on the bedstead may be warmed and dried effectively, while the room air may be warmed and circulated at the same time. Moreover, by use of the deodorizer and germicidal lamp, the room air may be cleaned.

The bed device according to the present invention, permits an optimum temperature and air circulation to be obtained for providing an ideal sleeping environment. As the mattress may be dried spontaneously in situ, the troublesome operation of drying the quilt may be dispensed with. The bed device of the present invention is suitable for prolonged usage by the aged and invalids and may be highly effective to promote their recovery from illnesses.

The present invention provides a special advantage in that there is no necessity of using a heating or ventilating device having movable parts. The bed device equipped with a motor or fan having movable parts is not suitable because these movable parts give rise to noise and vibration and degrade the environment of the sleeping room. As the heat radiator used in the present invention has no such moving parts, there is provided an optimum sleeping environment free from noise or vibrations.

I claim:

1. A bed device comprising a supporting base portion for supporting a reclining person, a generally horizontal passage below said base portion and extending beneath the upper surface of the base portion, permeable means in said base portion for communicating between said horizontal passage and a space above the base portion; an upwardly extending passage at one end of said base portion; one end portion of said horizontal passage being in communication with the lower end of said upwardly extending passage; said upwardly extending passage having an upper opening which is substantially higher than said generally horizontal passage; an air inlet opening at another end of said horizontal passage; a closable air discharge portion being provided at the upper end of the upwardly extending passage for communicating with the air space surrounding the device and means for moving air through said generally horizontal passage and said upwardly extending passage by a chimney effect.

2. A device as claimed in claim 1, in which said means for moving air includes a germicidal lamp in one of the upwardly extending passage and the generally horizontal passage.

3. A device as claimed in claim 1 or 2, in which said means for moving air includes a heat radiator in one of the upwardly extending passage and the generally horizontal passage.

4. A device as claimed in claim 1 further comprising a humidifier in one of the upwardly extending passage and the generally horizontal passage.

5. A bed device, comprising a base portion for supporting a reclining person, said base portion being permeable to transmit air transversely therethrough, a horizontal passage provided beneath said base portion and communicating with an area above said base portion for the overall surface of the base portion, said horizontal passage having at least one end portion, and a vertical passage provided at one end of said horizontal passage and communicating at the lower end thereof with said one end portion, and a closable air discharge opening at the upper end of said vertical passage for communicating with the inner space of a bedroom, an air inlet opening at another end of said horizontal passage, and means for moving air through said horizontal passage and said vertical passage by a chimney effect.

6. A bed device as claimed in claim 5 wherein said means for moving air includes a germicidal lamp in one of the vertical passage and horizontal passage.

7. A bed device as claimed in claim 5 or 6, in which said means for moving air includes a heat radiator in one of the vertical passage and horizontal passage.

8. A bed device as claimed in claim 7 further comprising a humidifier in one of the vertical passage and horizontal passage.

9. A bed device including a bedstead, comprising a base portion permeably disposed to transmit air transversely therethrough, a horizontal passage beneath said base portion and communicating with an area above said base portion for the overall area of the base portion, said horizontal passage having at least one end portion, a vertical passage at one end of said horizontal passage and communicating at the lower end thereof with said one end portion, an air inlet opening at a second end of said horizontal passage, a closable air discharge opening at the upper end of said vertical passage for communicating with the inner space of the bedroom, and chimney effect means for moving air through said horizontal passage and said vertical passage.

10. A bed device as claimed in claim 9 in which said chimney effect means includes a germicidal lamp in at least one of the vertical passage and the horizontal passage.

11. A bed device as claimed in claim 9 or 10, in which said chimney effect means includes a heat radiator in at least one of the vertical passage and the horizontal passage.

12. A bed device as claimed in claim 9, further comprising a humidifier in at least one of the vertical passage and the horizontal passage.

13. A bed device comprising a hollow mattress made of air permeable material, a hollow base portion in said mattress, a hollow upright portion in said mattress extending from one end of said base portion, said base portion providing a horizontal passage having at least one end portion, said upright portion providing a vertical passage communicating at the lower end thereof with said one end portion, an air inlet opening at a second end of said horizontal passage, a closable air discharge opening at the upper end of said vertical passage for communicating with the inner space of the bedroom, and means for moving air through said horizontal passage and said vertical passage by chimney effect.

14. A bed device as claimed in claim 13 in which said means for moving air includes germicidal lamp in at least one of the vertical passage and the horizontal passage.

15. A bed device as claimed in claim 13 or 14, in which said means for moving air includes a heat radiator in at least one of the vertical passage and the horizontal passage.

16. A bed device as claimed in claim 13 further comprising a humidifier in at least one of the vertical passage and the horizontal passage.

17. A bed device comprising a bedstead; a hollow mattress made of air permeable material on said bedstead, said bedstead including a base portion designed to permeably transmit air transversely therethrough, a horizontal passage beneath said base portion and communicating with an area above said base portion, said horizontal passage having at least one end portion, a vertical passage provided at one end of said horizontal passage and communicating at the lower end thereof with said one end portion, an air inlet opening at a second end of said horizontal passage, a closable air discharge opening at the upper end of said vertical passage for communicating with the inner space of the bedroom, and chimney effect means for moving air through said horizontal passage and said vertical passage.

18. A bed device as claimed in claim 17 including a germicidal lamp in at least one of the vertical passage and the horizontal passage.

19. A bed device as claimed in claim 17 or 18, in which said chimney effect means includes a heat radiator in at least one of the vertical passage and the horizontal passage.

20. A bed device as claimed in claim 17 further comprising a humidifier in at least one of the vertical passage and the horizontal passage.

21. A bed device having first and second ends comprising:

a supporting portion having an upper surface for supporting a reclining person;

a generally horizontal passage between said first and second ends below said base portion;

permeable means through said supporting portion between said horizontal passage and said upper surface for transversely passing air therethrough;

an air admitting opening at said first end of said bed communicating with an end of said horizontal passage;

a vertical passage at said second end of said bed communicating with another end of said horizontal passage and forming a continuous passage therewith;

an upper end of said vertical passage being an air discharging opening which is substantially higher than said air admitting opening;

a heat source in said continuous passage;

a germicidal lamp in said continuous passage; and at least one of said heat source and said germicidal lamp being effective to produce circulation of air through said continuous passage by chimney effect whereby fresh air is circulated past said permeable means and said supporting portion is maintained fresh and dry.

22. A bed device according to claim 21, further comprising humidifying means in said continuous passage.

23. A bed device according to claim 21, wherein said continuous passage includes an upward sloping portion of said horizontal passage which joins said vertical passage at a highest point in said upward sloping portion.

24. A bed device according to claim 23, wherein said upward sloping portion includes a step portion between a lower level portion and a higher level portion in said substantially horizontal passage.

25. A bed device according to claim 21, further comprising closable means in said vertical passage for controlling the flow of air therethrough.

* * * * *